US005390917A

United States Patent [19]

Mendoza

[11] Patent Number: 5,390,917

[45] Date of Patent: Feb. 21, 1995

[54] PUTTING PRACTICE DEVICE

[76] Inventor: Henry Mendoza, 9137 Inverness Rd., Santee, Calif. 92071

[21] Appl. No.: 218,823

[22] Filed: Mar. 28, 1994

[51] Int. Cl.[6] ..... A63B 57/00

[52] U.S. Cl. ..... 273/34 B

[58] Field of Search ..... 273/34 R, 34 A, 34 B, 273/178 R, 180

[56] References Cited

U.S. PATENT DOCUMENTS

| | | | |
|---|---|---|---|
| 4,120,496 | 10/1978 | Niina | 273/34 R |
| 4,280,698 | 7/1981 | Troiano | 273/34 B |
| 4,861,033 | 8/1989 | Miner | 273/177 R |
| 4,906,006 | 3/1990 | Sigunick | 273/178 R |
| 4,936,583 | 6/1990 | Peabody et al. | 273/177 R |
| 5,078,394 | 1/1992 | Kretz | 273/34 B |
| 5,205,559 | 4/1993 | Plopper | 273/177 R |

FOREIGN PATENT DOCUMENTS

| | | | |
|---|---|---|---|
| 23425 | 7/1936 | Australia | 273/34 R |

*Primary Examiner*—George J. Marlo

*Attorney, Agent, or Firm*—Brown, Martin, Haller & McClain

[57] ABSTRACT

A body having an annular surface and pins movable in a radial direction with respect to the annular surface. The annular surface may have simulated turf. When the pins are retracted, the body can be inserted in the hole with the annular surface in flush alignment with the surface of the turf surrounding the hole. The pins can then be extended into the material, such as soil, that surrounds the hole. The device can thus be inserted to the precise depth necessary to level the annular surface with the surrounding turf. The pins can quickly and easily be extended to secure the device in the hole or retracted to remove the device from the hole. A golfer can retrieve the ball by inserting fingers or a ball-retriever into the central opening of the annular surface without inadvertently dislodging the device because the pins securely hold the device in place.

12 Claims, 1 Drawing Sheet

PUTTING PRACTICE DEVICE

BACKGROUND OF THE INVENTION

The present invention relates generally to devices for improving a golfer's skills and, more specifically, to a device for decreasing the area of a golf hole.

Golfers can improve the accuracy of their putts by practicing hitting the ball into a hole that has a diameter smaller than that of a typical hole. Practitioners in the art have developed annular inserts for golf holes that effectively reduce the area of the hole. U.S. Pat. No. 4,280,698, issued to Troiano, discloses an annular cap with a plurality of resilient teeth around its periphery that extend downwardly into the hole. The teeth flex inwardly when the device is inserted into the hole and frictionally hold the device in place. However, the Troiano device is easily dislodged when the golfer inserts his fingers into the hole to retrieve a ball. U.S. Pat. No. 5,078,394, issued to Kretz, discloses an annular cap with a circumferential lip. The lip rests on the surface of the turf surrounding the hole. The Kretz device is not only easily dislodged but it is also difficult to align the annular surface of the device so that it is flush with the surrounding turf.

It would be desirable to provide a golf practice device that effectively reduces the area of a golf hole, that can be easily aligned with the surrounding turf, that can be quickly inserted and removed, and that cannot be inadvertently dislodged. These problems and deficiencies are clearly felt in the art and are solved by the present invention in the manner described below.

SUMMARY OF THE INVENTION

The present invention comprises a body having an annular surface and a plurality of pins extending radially outward with respect to the annular surface. The annular surface may have simulated turf. The pins are radially movable with respect to the annular surface. When the pins are moved to a retracted position, the body can be inserted in the hole with the surface in flush alignment with the surface of the turf surrounding the hole. The pins can then be moved to an extended position in which they extend into the material, such as soil, that surrounds the hole. The device can thus be inserted to the precise depth necessary to level the annular surface with the surrounding turf. The pins can be quickly and easily extended to secure the device in the hole. A golfer can retrieve the ball by inserting fingers or a ball-retriever into the central opening of the device without inadvertently dislodging the device because the pins securely hold the device in place.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
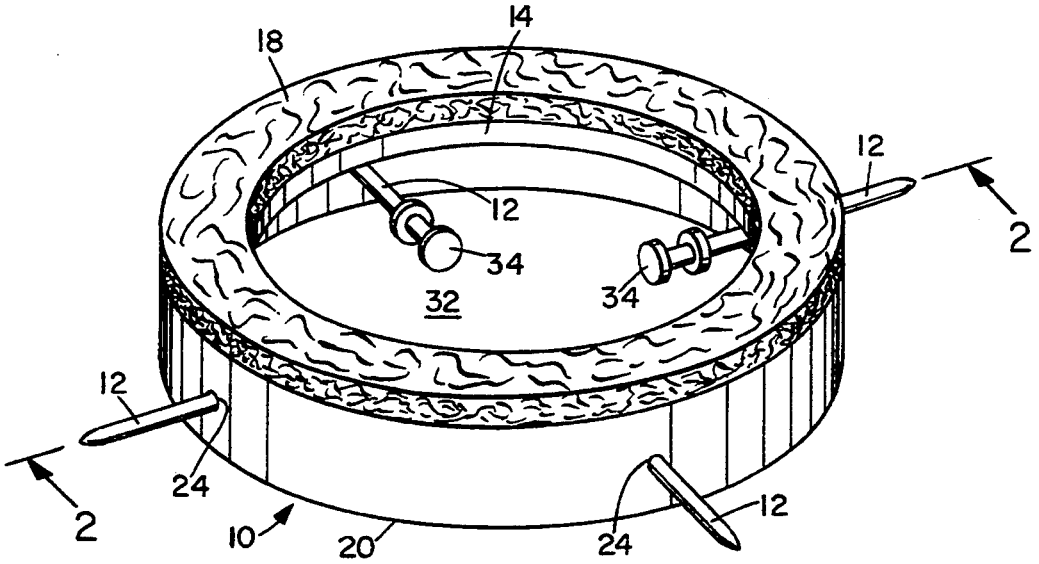
FIG. 1 is a perspective view of the device.

As illustrated in FIG. 1, a putting practice device comprises a generally annular body 10 and four pins 12. Body 10 may be made of any suitable material, such as plastic. Pins 12 may be made of any suitable durable material, such as metal.

Figure 2:
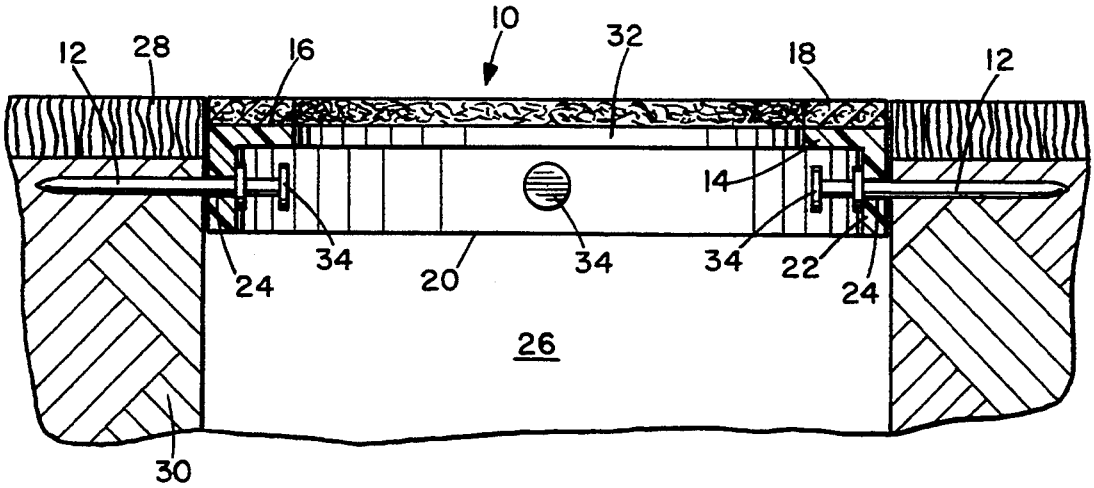
FIG. 2 is a sectional view taken along line 2—2 of FIG. 1, showing the device installed in a golf hole.

Body 10 preferably has a generally L-shaped cross-section, as best illustrated in FIG. 2. The upper portion 14 of body 10 has an annular surface 16 that may be covered with a material 18 that simulates turf, such as green felt. Material 18 may be attached to annular surface 16 with a suitable adhesive.

The lower portion 20 of body 10 has a tubular shape with an inside diameter greater than that of upper portion 14. Lower portion 20 as a wall 22, around the periphery of which are distributed a plurality of holes 24. Pins 12 are extendable through holes 24, as described below.

To use the putting practice device, the golfer inserts lower portion 20 into a golf hole 26 until annular surface 16 or the exposed surface of material 18 is level with the turf 28 surrounding hole 26. Although any suitable mechanism may be included in the present invention for moving pins 12, they are preferably freely slidable in holes 24 when grasped by a golfer and moved in a radial direction. To secure the putting practice device in golf hole 26 the user grasps pins 12 and extends them outwardly into the soil 30 surrounding golf hole 26.

The user may attempt to putt a golf ball (not shown) into the central opening 32. The smaller the diameter of central opening 32 the more accurate the putt needed to sink the ball in central opening 32. A golfer (not shown) may be provided with a plurality of devices of the present invention, each having a different diameter central opening 32. The golfer may select the device having a central opening diameter that he believes will provide the optimal challenge to his ability. As the golfer's ability improves, the golfer may select devices having successively smaller central opening diameters.

To remove the putting practice device from hole 26, a golfer grasps pins 12 and retracts them inwardly. Each pin 12 preferably has an elongated or dual head 34 to aid the user in grasping it. However, when extended fully outwardly, elongated head 34 is not visible in opening 32 because it is covered by upper portion 14. Furthermore, although each pin 12 may have a suitable means for preventing it from becoming completely separated from body 10 and misplaced, it is preferably removable by continuing to retract it until it is completely withdrawn from body 12. When separated from body 10, a golfer may carry pins 12 in his pocket or other suitable receptacle (not shown).

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A putting practice device for reducing the diameter of a cylindrical golf hole, comprising:

a body having an annular surface and a tubular portion connected to and coaxially disposed with respect to said annular surface, said tubular portion having a wall defining an inner diameter and an outer diameter with a plurality of holes extending through said wall and distributed around said tubular portion, said annular surface having an outer diameter and an inner diameter, said outer diameter substantially equal to a diameter of said golf hole, said inner diameter less than said diameter of said golf hole; and a plurality of pins, each disposed in one of said holes, said pins selectably extendable and retractable in a radial direction with respect to said annular surface, each pin having an elongated grip for grasping between a person's fingers, said grip disposed inside said wall when a portion of said pin extends through one of said holes and into the material surrounding said cylindrical gold hole.

2. The putting practice device claimed in claim 1, wherein said grip comprises a double head.

3. The putting practice device claimed in claim 2, wherein the number of pins in said plurality of pins is four.

4. The putting practice device claimed in claim 1, wherein said annular surface has a covering simulative of turf.

5. The putting practice device claimed in claim 1, wherein said outer diameter of said tubular portion is substantially equal to said outer diameter of said annular surface.

6. The putting practice device claimed in claim 5, wherein said inner diameter of said tubular portion is larger than said inner diameter of said annular surface.

7. The putting practice device claimed in claim 6, wherein said grip has a length less than or equal to one-half the difference between said inner diameter of said annular surface and said inner diameter of said tubular portion.

8. A putting practice device for reducing the diameter of a cylindrical golf hole, comprising:

an L-shaped body having an annular surface and a tubular portion, said annular surface having an outer diameter substantially equal to a diameter of said golf hole and an inner diameter less than said diameter of said golf hole, said tubular portion having a wall with a plurality of holes disposed around its periphery; and a plurality of pins disposed in said holes, said pins selectably extendable and retractable in a radial direction with respect to said annular surface, each pin having an elongated grip for grasping between a person's fingers and disposed inside said wall of said tubular portion when a portion of said pin extends through one of said holes in said wall of said tubular portion and into the material surrounding said cylindrical golf hole.

9. The putting practice device claimed in claim 8, wherein said annular surface has a covering simulative of turf.

10. The putting practice device claimed in claim 9, wherein the number of pins in said plurality of pins is four.

11. The putting practice device claimed in claim 8, wherein said grip comprises a double head.

12. A method for using a putting practice device to reduce the diameter of a cylindrical golf hole, comprising the steps of:

inserting at least a portion of a body having an annular surface into said golf hole, said annular surface having an outer diameter substantially equal to a diameter of said golf hole and an inner diameter less than said diameter of said golf hole; and extending a plurality of pins disposed around the periphery of said body in a radially outward direction into material surrounding said golf hole;

retracting said plurality of pins, each having an elongated grip, by grasping said grip and urging said grip in a radially inward direction out of said material surrounding said golf hole; and removing said body from said golf hole.

* * * * *